US005534378A

United States Patent [19]

Adel et al.

[11] Patent Number: 5,534,378

[45] Date of Patent: Jul. 9, 1996

[54] CARRIERS DOUBLY COATED WITH METAL OXIDE AND INTENDED FOR ELECTRO-PHOTOGRAPHY

[75] Inventors: Jörg Adel, Ludwigshafen; Rainer Dyllick-Brenzinger, Weinheim, both of Germany

[73] Assignee: BASF Aktiengesellschaft, Ludwigshafen, Germany

[21] Appl. No.: 408,987

[22] Filed: Mar. 23, 1995

[30] Foreign Application Priority Data

Mar. 23, 1994 [DE] Germany ..... 44 09 966.5

[51] Int. Cl.[6] ..... G03G 9/107; G03G 9/113

[52] U.S. Cl. ..... 430/106.6; 430/108

[58] Field of Search ..... 430/106.6, 108

[56] References Cited

U.S. PATENT DOCUMENTS

| | | | |
|---|---|---|---|
| 4,816,364 | 3/1989 | Oishi et al. | 430/106.6 X |
| 4,925,762 | 5/1990 | Ostertag et al. | 430/106.6 |
| 5,039,587 | 8/1991 | Czech et al. | 430/108 |
| 5,256,513 | 10/1993 | Kawamura et al. | 430/108 X |
| 5,478,687 | 12/1995 | Ogawa et al. | 430/106.6 |

FOREIGN PATENT DOCUMENTS

| | | | |
|---|---|---|---|
| 0303918 | 2/1989 | European Pat. Off. . | |
| 4140900A1 | 6/1993 | Germany . | |
| 188548 | 8/1986 | Japan | 430/108 |
| 83 | 1/1990 | Japan | 430/108 |
| 2001447 | 1/1979 | United Kingdom . | |
| WO93/12470 | 6/1993 | WIPO . | |

OTHER PUBLICATIONS

Database WPI, Derwent Publications, AN 85-321777, JP-A-60227266, Nov. 12, 1985.

Patent Abstracts of Japan, vol. 13, No. 89 (P-836), Mar. 2, 1989, JP-A-63271473, Nov. 9, 1988.

*Primary Examiner*—Roland Martin
*Attorney, Agent, or Firm*—Oblon, Spivak, McClelland, Maier & Neustadt

[57] ABSTRACT

Carriers for electrophotography, based on magnetic cores coated with different metal oxides, have A) a first layer which essentially consists of electrically insulating metal oxide and B) a second layer which essentially consists of metal oxide controlling the electrostatic charging of the toner and which does not substantially decrease the electroresistance of the carriers, which resistance is provided by the layer (A).

5 Claims, No Drawings

CARRIERS DOUBLY COATED WITH METAL OXIDE AND INTENDED FOR ELECTRO-PHOTOGRAPHY

The present invention relates to novel carriers for electrophotography, based on magnetic cores coated with different metal oxides, which have A) a first layer which essentially consists of electrically insulating metal oxide and B) a second layer which essentially consists of metal oxide controlling the electrostatic charging of the toner and which does not substantially decrease the electroresistance of the carrier, which resistance is provided by the layer (A).

The present invention furthermore relates to the preparation of these carriers and their use for the preparation of electrophotographic graphic two-component developers.

Two-component developers are used in electrophotographic copiers and laser printers for developing an electrophotographically produced, latent image and usually consist of carrier particles and toner particles. The carrier particles are magnetizable particles having sizes of, as a rule, from 20 to 1000 μm. The toner particles consist essentially of a color-imparting component and binder and have a size of from about 5 to 30 μm.

In the copying process, the electrostatic, latent image is produced by selective exposure of an electrostatically charged photoconductor drum to light reflected by the original. In the laser printer, this is done by means of a laser beam.

For the development of the electrostatic image, toner particles are transported to the photoconductor drum via a magnetic brush, ie. carrier particles oriented along the field lines of a sectored magnet. The toner particles adhere electrostatically to the carrier particles and, as a result of friction, are given an electrostatic charge opposite to that of the carrier particles during transport in the magnetic field. The toner particles thus transferred by the magnetic brush to the photoconductor drum produce a toner image, which is then transferred to electrostatically charged paper and fixed.

The carrier particles used have to meet a number of requirements: they should be magnetizable and thus permit rapid establishment of the magnetic brush. Furthermore, their surface should have low conductivity in order to prevent a short-circuit between the sectored magnet and the photoconductor drum. This conductivity should remain constant over long operating times of the carrier, in order also to keep the triboelectric charging of the developer constant over a long period. Not least, the carrier particles should also be free-flowing and should not agglomerate in the developer storage vessel.

In order to meet these requirements, the carrier particles consisting of a magnetic material must as a rule be coated.

EP-A-303 918 and DE-A-41 40 900 disclose carriers which are singly coated with metal oxide and which permit unrestricted charging of toners, but simultaneous control of the electrical resistance of the carriers is not possible.

Finally, the prior German Patent Application P 44 03 678.7 furthermore describes carriers which are doubly coated with a metal layer and a metal oxide layer and have low resistances of, as a rule, from $10^3$ to $10^8$ ohm.

Carriers which provide a high, in particular positive toner charge and at the same time are electrically insulating (ie. have resistances $>10^{10}$ ohm) are however not yet known. Such carriers are of interest in particular for office copiers and other low-speed systems.

It is an object of the present invention to provide carriers for electrophotography which correspond to this property profile.

We have found that this object is achieved by carriers for electrophotography, based on magnetic cores coated with different metal oxides, which have A) a first layer which essentially consists of electrically insulating metal oxide and B) a second layer which essentially consists of metal oxide controlling the electrostatic charging of the toner and which does not substantially decrease the electroresistance of the carriers, which resistance is provided by the layer (A).

We have also found a process for the preparation of these carriers, wherein the metal oxide layers are applied to the carrier cores by a wet chemical method, by hydrolysis of organic metal compounds in which the organic radicals are bonded to the metals via oxygen atoms, in the presence of an organic solvent in which the metal compounds are soluble, or by gas-phase decomposition of volatile metal compounds in the presence of oxygen and/or steam.

We have furthermore found a process for the preparation of carrier cores coated with alumina, wherein alkylaluminums are decomposed in the gas phase in the presence of oxygen and agitated carrier cores.

We have also found the use of these carriers for the preparation of electrophotographic two-component developers.

The cores of the novel carriers may consist of the conventional magnetically soft materials, such as iron, steel, magnetite, ferrites (for example nickel/zinc, manganese/zinc or barium/zinc ferrites), cobalt or nickel or of magnetically hard materials, such as $BaFe_{12}O_{19}$ or $SrFe_{12}O_{19}$, and may be in the form of spherical or irregularly shaped particles or in sponge form. Composite carriers, ie. particles of these metals or metal compounds which are embedded in polymer resin, are also suitable.

Titanium dioxide, alumina, iron oxide and especially silica, as well as mixtures thereof, are particularly suitable for the first, electrically insulating metal oxide layer (A).

The thickness of the layer (A) is dependent on the desired level of electrical resistance of the carrier and is in general from 10 to 500 nm, preferably from 30 to 300 nm, particularly preferably from 50 to 200 nm.

Metal oxides, such as molybdenum oxide, tungsten oxide and tin dioxide, which produce a highly positive toner charge, are particularly preferred for the second metal oxide layer (B) controlling the electrostatic charging of the toner.

The thickness of the layer (B) should be chosen as a function of the electrical conductivity of the metal oxides used. Conductive layers (B) which are too thick reduce the electrical resistance of the carrier, which resistance is provided by the layer (A).; layers (B) which reduce the resistance by not more than about 1.5 powers of ten are particularly suitable. As a rule, the layer (B) will therefore be from 1 to 50 nm, preferably from 2 to 20 nm, thick.

In the novel process for the preparation of the coated carriers, the metal oxide layers are applied to the carrier cores either by a wet chemical method, by hydrolysis of organic metal compounds in which the organic radicals are bonded to the metals via oxygen atoms, in the presence of an organic solvent, or by gas-phase decomposition of volatile metal compounds in the presence of oxygen and/or steam (chemical vapor deposition, CVD).

The wet chemical procedure is particularly suitable for coating with silica. However, the other metal oxides, too, can of course be applied by precipitation from aqueous solutions or from solutions in organic solvents.

Suitable organic solvents for this purpose are both aprotic solvents, such as ketones, β-diketones, ethers, especially cyclic ethers, and nitrogen-containing solvents, for example amide solvents, and protic solvents, such as monohydric or polyhydric alcohols of, preferably, 1 to 6 carbon atoms, which are miscible with water.

Examples of preferred solvents are acetone, tetrahydrofuran, ethanol, n-propanol, isopropanol, diethyl ketone, acetylacetone, dioxane, trioxane, ethylene glycol, propylene glycol, glycerol, dimethylformamide, dimethylacetamide, N-methylpyrrolidone, pyridone and acetonitrile.

Organic compounds which are soluble in the stated organic solvents and in which the organic radicals are bonded to the metals via oxygen atoms are suitable as metal-containing starting compounds. Preferred examples are the acetylacetonates and in particular alcoholates, especially $C_1$–$C_4$-alkanolates, eg. tetraethoxysilane and aluminum triisopropylate.

The hydrolysis is preferably carried out in the presence of a base or of an acid as catalyst. For example, in addition to alkalis, such as sodium hydroxide solution, aqueous ammonia solutions are particularly suitable for this purpose. Examples of suitable acidic catalysts are phosphoric acid and organic acids, such as acetic acid and oxalic acid.

Water should be present at least in the stoichiometric amount required for the hydrolysis, but from 2 to 100, in particular from 5 to 20, times the amount is preferred. As a rule from 3 to 40, preferably from 5 to 30% by volume, based on the amount of water used, of a 25% strength by weight aqueous ammonia solution is added.

With regard to the temperature, it has proven advantageous to heat the reaction mixture gradually to the reflux temperature in the course of from 10 to 48 hours. When isopropanol is used as the solvent, the mixture is stirred, for example, preferably initially for from 4 to 20 hours at 40° C., then for from 4 to 20 hours at 60° C. and finally for from 2 to 8 hours at 80° C.

The process is advantageously carried out as follows:

The carrier cores, organic solvent, water and base are initially taken and the metal compound to be hydrolyzed, in pure form or dissolved, is added, for example as a 30–70, preferably 40–60, % strength by volume solution in an organic solvent. If the metal compound is added in one step, the stirred suspension is then heated as described above. However, the metal compound can also be metered in continuously at elevated temperatures, the water preferably not being initially taken but likewise being metered in continuously. After the end of the coating process, the reaction mixture is cooled again to room temperature.

In order to prevent agglomeration during the coating process, the suspension can be subjected to vigorous mechanical stress, such as pumping, vigorous stirring or the action of ultrasonics.

If desired, the coating step can be repeated, although this is generally unnecessary. If the mother liquor has a milky opaque appearance, it is advisable to replace it prior to a further coating step.

The carrier cores coated with the layer (A) can be isolated in a simple manner by filtering off, washing with an organic solvent, preferably with the alcohol also used as solvent, and subsequent drying (usually for from 1 to 5 hours at from 100° to 250° C.).

Suitable volatile metal compounds for the CVD procedure are in particular the metal alcoholates, metal halides, metal carbonyls and metal organyls.

Specific examples of preferred compounds are titanium alcoholates, in particular titanium tetraisopropylate, silicon halides, such as silicon tetrachloride, iron carbonyls, in particular iron pentacarbonyl, molybdenum carbonyls, in particular molybdenum hexacarbonyl, molybdenum aryls, such as dibenzenemolybdenum, tunsten carbonyls, in particular tungsten hexacarbonyl, tungsten aryls, such as dibenzenetungsten, tin halides, in particular tin tetrachloride, tin organyls, in particular tetrabutyltin, alkylaluminums, in particular $C_1$–$C_6$-alkylaluminums, such as trimethylaluminum, triethylaluminum and triisobutylaluminum.

As described in the prior German Patent Application P 44 03 679.5, particularly suitable tin compounds are also tin organyls which can be vaporized under inert conditions essentially without decomposition and can be decomposed in the gas phase oxidatively, for example by reaction with oxygen or air or other oxygen/inert gas mixtures, to give tin dioxide, since they permit particularly gentle coating of the carrier cores.

Compounds of the formula SnR4, where the radicals R are identical or different and are each alkyl, alkenyl or aryl, for example tetraalkyltins, tetraalkenyltins and tetraaryltins and mixed arylalkyltins and alkylalkenyltins, are particularly suitable.

The number of carbon atoms in the alkyl, alkenyl and aryl radicals is in principle unimportant, but those compounds which have a sufficiently high vapor pressure at up to about 200° C are preferred, in order to ensure easy vaporization.

Accordingly, in tin organyls having 4 identical radicals R, in particular $C_1$–$C_6$-alkyl radicals, especially $C_1$–$C_4$-alkyl radicals, $C_2$–$C_6$-alkenyl radicals, especially allyl radicals, and phenyl radicals are preferred.

Finally, dinuclear or polynuclear tin organyls, which may be bridged, for example, via oxygen atoms, may also be used.

Examples of suitable organotin compounds are diallyldibutyltin, tetraamyltin, tetra-n-propyltin, bis(tri-n-butyltin) oxide and especially tetra-n-butyltin and tetramethyltin.

The decomposition temperatures of the tin organyls are as a rule from 200° to 1000° C., preferably from 300° to 500° C.

The temperature and also the amount of oxygen are advantageously chosen so that the oxidation of the organic radicals to carbon dioxide and water is complete and no carbon is incorporated in the tin dioxide layer. If in fact the amount of oxygen passed in is less than the stoichiometrically required amount, depending on the chosen temperature either the tin organyl is only partially decomposed and then condenses in the waste gas zone or carbon black and other decomposition products are formed.

Furthermore, the evaporator gas stream containing the tin organyl should advantageously be adjusted so that the gaseous tin organyl accounts for not more than about 10% by volume of the total amount of gas in the reactor, in order to avoid the formation of finely divided, particulate tin dioxide. An advantageous concentration of tin organyl in the carrier stream itself is usually $\leqq 5\%$ by volume.

The oxidative decomposition of metal carbonyls and of the further metal organyls to the corresponding metal oxides is preferably likewise carried out using oxygen or air or other oxygen/inert gas mixtures. In general, reaction temperatures of from 100° to 400° C are suitable for this purpose. The decomposition of alkylaluminums is carried out, as a rule, at from 200 to 1000° C., preferably from 300 to 500° C.

The hydrolysis of metal halides or metal alcoholates with steam for the formation of the metal oxides is usually effected at from 100° to 600° C., the halides generally requiring the highest temperatures.

Suitable reactors for the gas-phase coating are stationary or rotating tubes or agitated mixing units in which an agitated fixed bed or fluidized bed of the carrier cores to be coated is present. The agitation of the carrier cores can be effected by fluidization with a gas stream, by free-fall mixing, by the action of gravity or with the aid of stirring elements in the reactor.

In coating by the CVD method, the concentration of the vaporized metal compound (and of the reaction gases) in the carrier gas should preferably be ≦5% by volume, in order to ensure uniform coating of the carrier. As described above for the tin organyls, the vaporization rates and the reaction temperatures should likewise be chosen so that the reaction is as complete as possible and there is no formation of finely divided metal oxide, which would be discharged with the waste gas stream. Further details appear in DE-A-41 40 900.

The thickness of the layers formed depends of course on the amount of metal compound added and can thus be controlled over the duration of coating. Both very thin and very thick layers can be applied.

The novel carriers are distinguished by the high quality of the applied metal oxide layers (homogeneous, film-like and abrasion-resistant) and have a resistance in the desired region of $>10^{10}$ ohm, ie. are electrically insulating.

In addition, they have long lives and can therefore in general be advantageously used with the commercial toners for the preparation of electrophotographic two-component developers, the carriers possessing high positive toner charges and coated with molybdenum oxide, tungsten oxide and/or tin oxide being particularly noteworthy.

EXAMPLE

Preparation and testing of a novel carrier 180 ml of a 25% strength by weight aqueous ammonia solution were added to a suspension of 4.5 kg of a ferrite carrier (barium/zinc ferrite, particle size from 45 to 105 μm, type KBN 100 from Hitachi, Japan) in 2250 ml of isopropanol. The mixture was heated to 40° C., after which 720 ml (669.6 g) of tetraethoxysilane were added dropwise in the course of 10 minutes.

After further stirring for four hours at 40° C. and for one hour each at 60° C. and 80° C., the supernatant milky opaque liquid phase was decanted. The carrier coated with $SiO_2$ or hydrated $SiO_2$ was washed three times with 1500 ml of isopropanol, filtered off and dried for 1 hour at 100° C.

A silicon content of 0.42% by weight was determined by means of atomic absorption spectroscopy.

Thereafter, 4 kg of the $SiO_2$-coated carrier were heated to 230° C. in an electrically heated fluidized-bed reactor (150 mm internal diameter, 130 cm high, with cyclone and carrier recycling) with fluidization with a total of 1800 l/h of nitrogen. 13.2 g of molybdenum hexacarbonyl were transferred to the reactor in the course of 3 hours with the aid of a stream of 400 l/h of nitrogen from an upstream evaporator vessel heated to 50° C. At the same time, 400 l/h of air were passed into the reactor via the fluidizing gas in order to effect oxidation.

After the end of the coating with molybdenum oxide, the carrier was cooled to room temperature with further fluidization with nitrogen.

A molybdenum content of 0.08% by weight was determined by means of atomic absorption spectroscopy.

In order to investigate the coated carrier, its electrical resistance and the electrostatic chargeability of a toner were determined.

The electrical resistance of the carrier was measured using the C meter from PES-Laboratorium (Dr. R. Epping, Neufahrn). For this purpose, the carrier particles were agitated for 30 s in a magnetic field of 600 Gauβ at a voltage of $U_o$ of 10 V. The capacitance C was 1 nF.

The resistance R can be calculated from the voltage drop as a function of time after the applied electric field has been switched off, using the following formula:

$$R=t/[C(\ln (U_o/U)]$$

where

R: is the resistance [ohm];

t: is the time of the measurement [s];

C: is the capacitance [F];

$U_o$: is the voltage at the beginning of the measurement [V]; and

U: is the voltage at the end of the measurement [V].

The resistance R is usually stated in logarithmic values (log R [log ohm]).

To determine the electrostatic chargeability, the carrier was mixed with a polyester resin toner suitable for commercial laser printers (crosslinked fumaric acid/propoxylated bisphenol A resin having a mean particle size of 11 μm and a particle size distribution of from 6 to 17 μm) in a weight ratio of 97:3, and the mixture was thoroughly mixed in a 30 ml glass vessel for 10 minutes in a tumbling mixer at 200 rpm for activation.

2.5 g of the developer thus prepared were weighed into a hard-blow-off cell (Q/M meter from PES-Laboratorium, Dr. R. Epping, Neufahrn) which was coupled to an electrometer and in which screens of mesh size 32 μm had been inserted. By blowing off with a vigorous air stream (about 3000 $cm^3$/min) and simultaneous suction, the toner powder was virtually completely removed whereas the carrier particles were retained in the measuring cell by the screens.

The voltage generated by charge separation was then read on the electrometer, and the charge build-up on the carrier was determined therefrom ($Q=\dot{C}\cdot u$, C=1 nF); said charge build-up corresponds to the charge build-up on the toner with the opposite sign and is related to the weight of the blown-off toner by reweighing the measuring cell, and the electrostatic charge Q/m [μC/g] of said toner is thus determined.

The following results were obtained in these investigations:

| | log R [log ohm] | Q/m [μC/g] |
|---|---|---|
| Crude carrier/$SiO_2$/$MoO_3$ | 10.28 | +20.7 |
| Crude carrier/$SiO_2$ (for comparison) | 11.48 | +8.9 |
| Crude carrier (for comparison) | 10.51 | −9.5 |

We claim:

1. A carrier for electrophotography, based on magnetic cores coated with different metal oxides, which has A) a first layer which consists essentially of electrically insulating metal oxide and B) a second layer which consists essentially of a different metal oxide controlling the electrostatic charging of the toner and which does not substantially decrease the electroresistance of the carrier, which resistance is provided by the layer (A).

2. A carrier as claimed in claim 1, in which the layer (A) consists essentially of silica, alumina, titanium oxide, iron oxide or a mixture thereof.

3. A carrier as claimed in claim 1, in which the layer (B) consists essentially of molybdenum oxide, tungsten oxide, tin oxide or a mixture thereof.

4. A carrier as claimed in claim 1, in which the layer (A) has a thickness of from 10 to 500 nm.

5. A carrier as claimed in claim 1, in which the layer (B) has a thickness of from 1 to 50 nm.

* * * * *